US006379267B1

(12) United States Patent
Yamagishi et al.

(10) Patent No.: US 6,379,267 B1
(45) Date of Patent: Apr. 30, 2002

(54) GOLF BALL

(75) Inventors: Hisashi Yamagishi; Takashi Maruko; Atsushi Nakamura, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/487,772

(22) Filed: Jan. 20, 2000

(30) Foreign Application Priority Data

Feb. 5, 1999 (JP) ..... 11-028771

(51) Int. Cl.[7] ..... A63B 37/04
(52) U.S. Cl. ..... 473/371; 473/377
(58) Field of Search ..... 473/367, 368, 473/385, 371, 376, 377, 378, 373, 374

(56) References Cited

U.S. PATENT DOCUMENTS

| | | | | |
|---|---|---|---|---|
| 5,253,871 A | * | 10/1993 | Viollaz | 473/374 |
| 5,702,312 A | * | 12/1997 | Horiuchi et al. | 473/377 |
| 5,730,664 A | * | 3/1998 | Asakura et al. | 473/374 |
| 5,830,087 A | * | 11/1998 | Sullivan et al. | 473/385 |
| 5,833,554 A | * | 11/1998 | Sullivan et al. | 473/374 |

FOREIGN PATENT DOCUMENTS

| | | | |
|---|---|---|---|
| JP | 7-24084 | 1/1995 | A63B/37/00 |
| JP | 7-24085 | 1/1995 | A63B/37/00 |
| JP | 9-239067 | 9/1997 | A63B/37/00 |
| JP | 9-239068 | 9/1997 | A63B/37/00 |
| JP | 10-151225 | 6/1998 | A63B/37/00 |
| JP | 10-248955 | 9/1998 | A63B/37/00 |

* cited by examiner

*Primary Examiner*—Mark S. Graham
*Assistant Examiner*—Raeann Gordon
(74) *Attorney, Agent, or Firm*—Sughrue Mion, PLLC

(57) ABSTRACT

In a golf ball comprising a core and a cover of at least two layers around the core, the cover layers including the outermost layer which is formed with a plurality of dimples, the cover outermost layer has a Shore D hardness of 30 to less than 51, and the product of the Shore D hardness of the cover outermost layer multiplied by the Shore D hardness of a cover layer disposed inside the cover outermost layer is from 1,000 to 3,500. The plurality of dimples include at least three types of dimples which are different in diameter and the ratio of average diameter to average depth of dimples is from 17 to 26. The overall dimple volume is 280–390 $mm^3$. The ball has an improved overall profile of performance including feel, durability, rebound, approach control and flight characteristics.

15 Claims, 1 Drawing Sheet

GOLF BALL

This invention relates to a golf ball comprising a core and a cover of at least two inner and outer layers and more particularly, to a golf ball of such structure having an improved overall profile of performance including feel, durability, rebound, approach control and flight characteristics.

BACKGROUND OF THE INVENTION

Many golf balls having different multilayer structures are known, for example, from JP-A 7-24084, 7-24085, 9-239067, and 9-239068. By tailoring their structure, these balls are improved in feel, durability and rebound.

JP-A 10-248955 discloses a two-piece solid golf ball comprising a solid core and a cover which is formed with a plurality of dimples in its surface. The plurality of dimples include at least three types of dimples which are different in diameter. The diameter (mm) divided by the depth (mm) of each dimple ranges from 18 to 27. The volume of each dimple divided by the volume of a cylinder whose diameter and height are equal to the diameter and depth of the dimple ranges from 0.390 to 0.550.

JP-A 10-151225 discloses a three-piece solid golf ball in which improvements in spin performance, feel and control with any type of club are attained by paying attention to the relationship of inertia moment to the ball structure and dimples. The ball has a high inertia moment, and the diameter/depth ratio of dimples is as low as about 17/1.

Since these proposals intend to improve the feel, durability and rebound of balls primarily by tailoring the ball structure, they fail to take full advantage of the spin performance and dimple aerodynamics having a significant influence on the flight following shots. There is thus room for further improvement.

The prior art golf balls do not fully meet the demand of users that the balls satisfy the feel, rebound, durability and approach control requirements imposed on the ball structure and offer good flight performance following shots, and thus have an advanced overall profile of performance.

SUMMARY OF THE INVENTION

An object of the invention is to provide an improved golf ball having an advanced overall profile of performance including a good feel, durability, rebound, approach control, and flight performance.

The invention is directed to a golf ball comprising a core and a cover of at least two layers around the core, the cover layers including the outermost layer which is formed with a plurality of dimples. It is understood that where the cover consists of two inner and outer layers, the outermost layer is simply referred to as the outer layer.

In the case of a golf ball having a cover consisting of two inner and outer layers, for example, it has been found that (1) spin is correlated to the hardnesses of the cover inner and outer layers such that the ball receives more spin when the cover inner or outer layer is soft, and the ball is less susceptible to spin when both the cover inner and outer layers are hard; and that (2) an optimum combination of the product of the Shore D hardness of the cover inner layer multiplied by the Shore D hardness of the cover outer layer with the overall dimple volume largely contributes to spin.

The invention provides a golf ball comprising a core and a cover of at least two layers around the core, the cover layers including the outermost layer which is formed in its outer surface with a plurality of dimples. The cover outermost layer has a Shore D hardness of 30 to less than 51. The product (A×B) of the Shore D hardness, represented by B, of the cover outermost layer multiplied by the Shore D hardness, represented by A, of a cover layer disposed inside and contiguous to the cover outermost layer is in the range of 1,000 to 3,500. It is understood that in the case of a cover consisting of inner and outer layers, the inside layer is the inner layer and in the case of a cover consisting of innermost, inner and outer layers, the inside layer is the inner layer. The plurality of dimples include at least three types of dimples which are different in diameter and have an average diameter (AD) and an average depth (AP) wherein the ratio (AD/AP) of the average diameter to the average depth is from 17/1 to 26/1. The overall dimple volume (Vs) which is the sum of the volumes of all dimple spaces each defined below a plane circumscribed by a dimple edge is in the range of 280 to 390 $mm^3$. Preferably the cover layer hardness product (A×B) and the overall dimple volume (Vs) are correlated such that Vs becomes smaller when A×B has a large value, and vice versa. More specifically, Vs is 310 to 390 $mm^3$ when A×B is from 1,000 to 2,500, and Vs is 280 to 340 $mm^3$ when A×B is from 2,000 to 3,500. Owing to the proper selection of hardness for the cover inner and outer layers and the optimum combination of the hardness product with a specific overall dimple volume, both factors providing significant contributions to spin, the ball upon full shots with a driver exhibits a gradually rising, boring trajectory, improved flight characteristics, and thus an increased distance. The ball satisfies the feel, durability, rebound (or restitution) and approach control requirements imposed on the ball structure and thus has an advanced overall profile of performance over the prior art.

In preferred embodiments, the core is formed of a rubber composition based on cis-1,4-polybutadiene; and the total number of dimples is 370 to 450.

DESCRIPTION OF THE PREFERRED EMBODIMENTS

Figure 1:
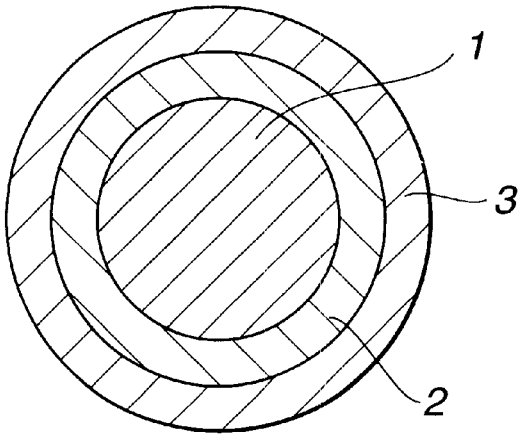
FIG. 1 is a schematic cross-sectional view of a golf ball according to one embodiment of the invention.

Referring to FIG. 1, a golf bell according to one embodiment of the invention is illustrated as comprising a core 1 and a cover around the core 1. The cover in this embodiment includes a cover inner layer 2 enclosing the core 1 and a cover outer layer 3 enclosing the inner layer 2. These layers are concentric with the core. The cover outer layer 3 is formed with a plurality of dimples (not shown) in its outer surface. In another embodiment, the cover is of three-layer structure including innermost, inner and outer layers.

The core may be formed of a rubber composition comprising polybutadiene as a base rubber. The polybutadiene used herein is preferably cis-1,4-polybutadiene containing at least 40% of cis structure. In the base rubber, another rubber component such as natural rubber, polyisoprene rubber or styrene-butadiene rubber may be blended with the polybutadiene if desired. Since resilience is improved by increasing the content of polybutadiene, the rubber component other than polybutadiene should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc dimethacrylate and zinc diacrylate, and esters such as trimethylpropane methacrylate. Of these, zinc diacrylate is preferred because it can impart high resilience. The crosslinking agent is preferably used in an amount of about 15 to 40 parts by weight per 100 parts by weight of the base rubber. Also a vulcanizing agent is generally blended in the rubber composition. Exemplary vulcanizing agents are dicumyl peroxide and mixtures of dicumyl peroxide and 1,1-bis(t-butylperoxy)-3,3,5-trimethylcyclohexane. The vulcanizing agent is preferably used in an amount of about 0.1 to 5 parts by weight per 100 parts by weight of the base rubber. In the rubber composition, antioxidants and specific gravity adjusting fillers such as zinc oxide and barium sulfate may be blended. The amount of such fillers blended is preferably 0 to about 130 parts My weight per 100 parts by weight of the base rubber.

The rubber composition is obtained by kneading the above-mentioned components in a conventional mixer such as a kneader, Banbury mixer or roll mill. The resulting compound is molded in a mold by injection or compression molding.

The core is preferably formed to a diameter of 25 to 40 mm, more preferably 27 to 39 mm and a weight of 10 to 40 g, more preferably 15 to 35 g.

The core should preferably have a hardness corresponding to a deflection of 3.0 to 6.0 mm, more preferably 3.0 to 5.5 mm under an applied load of 100 kg. A deflection of less than 3.0 mm indicates a hard core, sometimes leading to a poor feel wren hit. A deflection of more than 6.0 mm indicates a soft core, sometimes leading to a ball with less resilience.

The core is usually formed t a single layer structure from one material although it may also be formed to a two or multilayer structure from different materials if desired.

The golf ball of the invention has a cover of at least two inner and outer layers formed around the aforementioned core. It is acceptable that an intermediate layer or mantle be formed around the core and a cover of at least two inner and outer layers be formed around the mantle.

The intermediate layer used herein may be formed of well-known materials for such layers Use may be made of, for example, rubber compositions based on polybutadiene rubber, ionomer resins, thermoplastic polyester elastomers, and thermoplastic polyurethane elastomers, alone or in combination of two or more. The intermediate layer has a thickness of 0.8 to 5.0 mm, and especially 1.0 to 4.5 mm and a Shore D hardness of 5 to 65, And especially 10 to 60.

Typically, the core is enclosed with a cover of at least two inner and outer layers, preferably two or three layers. In the illustrated embodiment of FIG. 1, the cover consists of inner and outer layers 2 and 3, which are successively formed around the core 1. In the following description, reference is primarily made to the illustrated embodiment of FIG. 1. The cover inner and outer layers are generally formed of cover stocks based on thermoplastic resins. Useful thermoplastic resin are ionomer resins, polyester elastomers, polyamide elastomers, polystyrene elastomers, polyurethane elastomers, polyolefin elastomers, and mixtures thereof. The ionomer/resins are especially preferable and commercially available, for example, under the trade name of "Himilan" from Dupont-Mitsui Polychemical K.K. and "Surlyn" from E. I. duPont. If necessary, UV absorbers, antioxidants, and dispersants such as metal soaps may be added to the cover stocks. Similar cover stocks may be used when the cover is of three-layer structure.

According to the invention, the outermost layer (or outer layer in FIG. 1) of the cover has a Shore D hardness of 30 to less than 51, preferably 33 to 50, and more preferably 35 to 50. The cover outer layer with a too low Shore D hardness provides too much spin whereas the outer layer with a too high Shore D hardness provides too less spin, both failing to achieve optimum cooperation with the dimples. The cover inner layer preferably has a Shore D hardness of 10 to 70, and more preferably 15 to 65.

The cover inner and outer layers may be equal or different in Shore D hardness. Differently stated, either of the inner and outer layers may be softer than the other. The hardness difference between the inner and outer layers is selected as appropriate. Provided that the cover outermost (or outer) layer has a Shore D hardness B and a cover layer disposed inside and contiguous to the cover outermost layer (the inside layer being the inner layer in the illustrated embodiment having a two-layer cover of inner and outer layers, or the inner layer in the other embodiment having a three-layer cover of innermost, inner and outer layers) has a Shore D hardness A, the invention requires that the product of these hardnesses, A×B, be in the range of 1,000 to 3,500. The product A×B is preferably in the range of 1,500 to 3,000, and more preferably 2,000 to 3,000. A too small product A×B leads to too much spin whereas a too large product A×B leads to too less spin, both failing to achieve an optimum correlation of spin and dimples and to attain the objects of the invention. Where the cover is of three-layer structure (innermost, inner and outer layers), it is preferred that the inner and outer layers have a Shore D hardness in the same range as above and the innermost layer has a Shore D hardness in the same range as the inner layer.

In enclosing the core (optionally having the intermediate layer) with the cover of at least two layers, any desired molding method may be used. For example, injection molding or compression molding may be employed in a conventional manner.

No particular limits are imposed on the thickness of the cover inner and outer layers. Usually, the cover inner layer has a radial thickness or gage of 0.8 to 5.0 mm, and especially 1.0 to 3.0 mm; and the cover outer layer has a radial thickness or gage of 0.8 to 5.0 mm, and especially 1.0 to 4.0 mm.

Figure 2:
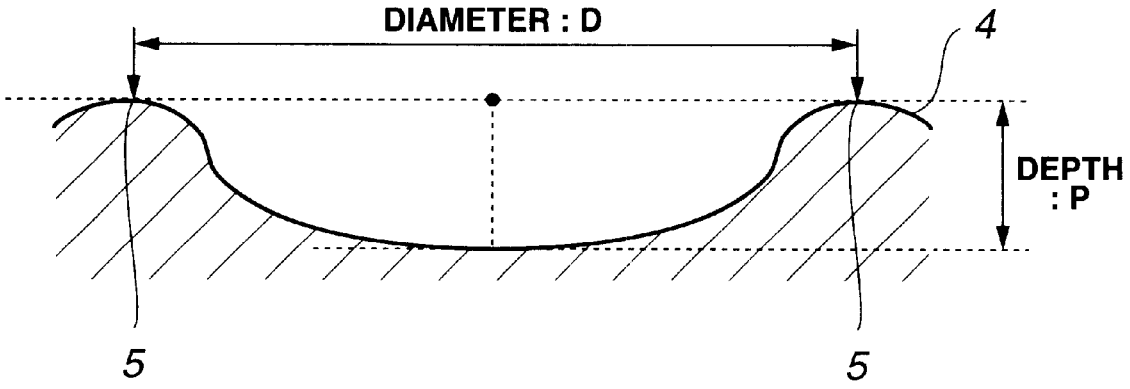
FIG. 2 is an enlarged cross-sectional view of one dimple in the ball surface.

In the golf ball of the invention, the cover outermost layer (which is the outer layer in the illustrated embodiment having a two-layer cover of inner and outer layers, or the outer layer in the other embodiment having a three-layer cover of innermost, inner and outer layers) is formed in its outer surface with a plurality of dimples. Typical dimples are circular in plane shape. As seen from the cross-sectional shape of FIG. 2, each dimple is a concave indentation having a bottom and a circular edge or top 5 where the dimple is connected to a land 4. Preferably the curvilinear line of the concave indentation is deformed near the edge to define a rounded edge portion as shown in FIG. 2.

The dimple has a diameter which is the distance D between the opposite edge points 5 (or the highest points) of the dimple where the dimple is joined to the land 4 (the ball surface where no dimple is formed). The dimple has a depth which is the vertical distance P from the center of an imaginary plane circumscribed by the dimple edge to the bottom (or deepest point) of the dimple. In most cases, the golf ball is surface coated with paint, wherein the diameter and depth of a dimple are those in the coated state.

The plurality of dimples include at least three types, preferably three to five types of dimples which are different in diameter. The dimple diameter is preferably in the range of 2.0 to 5.0 mm, more preferably 2.5 to 4.5 mm and the dimple depth is preferably in the range of 0.09 to 0.3 mm, more preferably 0.1 to 0.28 mm. The ratio of the average diameter (AD) to the average depth (AP) of dimples is from 17/1 to 26/1, preferably from 17.2/1 to 25.8/1, more preferably from 17.3/1 to 25.7/1. An AD/AP ratio of less than 17 causes the ball to take a rather dropping trajectory near landing whereas an AD/AP ratio of more than 26 causes the ball to follow a ballooning trajectory.

The average diameter (AD) of dimples used herein is represented by $(D_1+D_2+\ldots+D_n)/n$ (mm) when n types of dimples having different diameters $D_1, D_2, \ldots D_n$ (mm) are included. The average depth (AP) of dimples used herein is represented by $(P_1+P_2+\ldots+P_n)/n$ (mm) when n types of dimples having different depths $P_1, P_2, \ldots P_n$ (mm) are included. The average diameter (AD) and average depth (AP) are not related to the number of those dimples having the same diameter and depth.

The invention further requires that the overall dimple volume Vs be in the range of 280 to 390 $mm^3$, preferably 300 to 380 $mm^3$, and more Preferably 300 to 370 $mm^3$. The overall dimple volume Vs is the sum of the volumes of all dimple spaces each defined below a plane (depicted by broken lines in FIG. 2) circumscribed by the dimple edge. A too small value of Vs causes the ball to follow a rather ballooning trajectory whereas a too large value of Vs causes the ball to follow a nose-down trajectory and hence, a dropping trajectory.

In one preferred embodiment, the product (A×B) of the Shore D hardness B of the cover outermost layer (typically outer layer) multiplied by the Shore D hardness A of a cover layer (typically inner layer) disposed inside and contiguous to the cover outermost layer and the overall dimple volume (Vs) are correlated such that Vs becomes smaller when A×B has a large value, and Vs becomes greater when A×B has a small value.

Specifically, Vs is 310 to 390 $mm^3$, especially 315 to 385 $mm^3$ when A×B is from 1,000 to 2,500. Vs is 280 to 340 $mm^3$, especially 285 to 335 $mm^3$ when A×B is from 2,000 to 3,500. The selection of Vs and A×B so as to fall in the above range enables the provision of proper hardnesses for the cover inner and outer layers and the optimum combination of the hardness product with a specific overall dimple volume, both factors providing significant contributions to spin. As a result, excellent flight performance is established.

In addition to the above-described dimple parameters, the proportion $V_R$ (%) of the overall dimple volume Vs divided by the volume of an imaginary sphere given on the assumption that no dimples are formed in the golf ball surface is preferably 0.6 to 1.1%, a d more preferably 0.65 to 1.05%. The value $V_0$ of the volume of each dimple space defined below a plane circumscribed by the dimple edge divided by the volume of a cylinder hose bottom is that plane and whose height is the maximum depth of the dimple from the bottom preferably ranges from 0.30 to 0.70, more preferably from 0.35 to 0.65.

The total number of dimples is not critical although it is usually from 370 to 450, preferably from 370 to 440. The arrangement of dimples on the ball surface is not critical, and well-known regular octahedral and regular icosahedral arrangements are useful.

Preferably the golf ball as a whole has a hardness corresponding to a deflection of 2.4 to 4.5 mm, more preferably 2.45 to 4.2 mm under an applied load of 100 kg. In accordance with the Rules of Golf, the golf ball is formed to a diameter of not less than 42.67 mm and a weight of not greater than 45.93 grams.

There has been described a golf ball which satisfies the control on approach shots, feel, durability and restitution requirements and offers good flight characteristics, and thus has an advanced overall profile of performance.

EXAMPLE

Examples of the invention are given below by way of illustration and not by way of limitation.

Examples 1–5 & Comparative Examples 1–4

Core-forming rubber compositions of the formulation shown in Table 1 were worked in a kneader, molded in a mold and vulcanized at a temperature of 155° C. for about 15 minutes, forming cores designated (a) to (e).

Around each of the cores, cover stocks of the formulation shown in Table 2 were successively injection molded in the combination shown in Tables 4 and 5, forming a cover. Three-piece golf balls of Examples 1 to 5 and Comparative Examples 1 to 4 were manufactured in this way. On the surface of these golf balls, dimples of the types shown in Table 3 were formed during molding in the combination shown in Tables 4 and 5. It is noted that the golf ball of Example 5 is a solid golf ball of four-layer structure having an intermediate layer between the core and the cover.

The cores and the golf balls mere examined by the following tests. The results are also shown in Tables 4 and 5.

Core hardness and ball hardness

The hardness of the core or ball is expressed by a deflection (mm) under an applied load of 100 kg.

Flight performance

Using a swing robot of Miyamae K. K., the ball was actually hit at a head speed of 40 m/sec (HS40) with a driver (W#1, PRO 230 Titan, loft 10°, by Bridgestone Sports Co., Ltd.). Spin, carry, total distance, and trajectory were determined, on the basis of which flight performance was rated. With respect to the trajectory, twelve balls for each sample were actually hit and their trajectory was visually observed. With respect to the flight performance rating, the ball was rated "○" (good),"Δ" (average) or "x" (poor) by an overall examination based on all the data of spin, carry, total distance and trajectory.

Approach control

The ball was hit with a short iron. It was examined how the ball stopped on the green. The ball was rated "○" for good and "x" for poor.

Feel

Five amateur golfers with a head speed of about 40 m/sec actually hit the balls using a driver (W#1, same as above) and a putter (PT) as the club. They evaluated the feel according to the rating: "○" for very soft feel, "Δ" for average feel, and "x" for hard feel.

Durability

Using a swing robot of Miyamae K. K., the ball was repeatedly hit at a head speed of 45 m/sec (HS45) with a driver (W#1, PRO 230 Titan, loft 10°, by Bridgestone Sports Co., Ltd.). The ball surface was observed and evaluated according to the following criterion relative to the number of hits.

○: sound

Δ: relatively premature failure x: premature failure A

Overall evaluation

With all the test results taken together, the ball was evaluated "○" for good, "Δ" for average, and "x" for poor.

In Tables 1 and 2, all the amounts of ingredients blended are parts by weight. The trade name "BR01" is cis-1,4-polybutadiene by Nippon Synthetic Rubber K. K.; "Hytrel" is the trade name of polyester elastomer by Dupont-Toray K. K.; "Surlyn" is the trade name of ionomer resins by E. I. duPont; and "Himilan" is the trade name of ionomer resins by Dupont-Mitsui Polychemical K. K.

TABLE 1

| | Core | | | | |
|---|---|---|---|---|---|
| | a | b | c | d | e |
| BR01 | 100 | 100 | 100 | 100 | 100 |
| Zinc diacrylate | 29.0 | 29.5 | 26.1 | 28.5 | 41.0 |
| Zinc oxide | 5.0 | 5.0 | 5.0 | 5.0 | 5.0 |
| Antioxidant | 0.2 | 0.2 | 0.2 | 0.2 | 0.5 |
| Barium sulfate | 30.0 | 32.2 | 32.0 | 31.0 | 16.9 |

TABLE 1-continued

| | Core | | | | |
|---|---|---|---|---|---|
| | a | b | c | d | e |
| Dicumyl peroxide | 1.0 | 1.0 | 1.0 | 1.0 | 1.0 |
| Core diameter (mm) | 36.40 | 36.40 | 36.40 | 36.40 | 33.70 |

TABLE 2

| | Cover stock | | | | | | |
|---|---|---|---|---|---|---|---|
| | ① | ② | ③ | ④ | ⑤ | ⑥ | ⑦ |
| Hytrel 3078 | — | — | — | — | — | — | 100 |
| Surlyn 9320 | — | — | — | 50 | — | — | — |
| Surlyn 8120 | — | 30 | 50 | 50 | 50 | 100 | — |
| Himilan 1605 | 50 | 20 | — | — | — | — | — |
| Himilan 1706 | 50 | 50 | — | — | — | — | — |
| Himilan 1652 | — | — | 50 | — | — | — | — |
| Himilan 1855 | — | — | — | — | 50 | — | — |

Note:
Additionally, appropriate amounts of titanium dioxide and barium sulfate were blended.

TABLE 3

| Set | Diameter (mm) | Depth (mm) | Number of dimples | Total number of dimples | Average diameter AD (mm) | Average depth AP (mm) | AD/AP | Overall dimple volume ($mm^3$) |
|---|---|---|---|---|---|---|---|---|
| A | 4.050 | 0.140 | 62 | 432 | 3.513 | 0.140 | 25.1 | 301.8 |
| | 3.800 | 0.140 | 210 | | | | | |
| | 3.400 | 0.140 | 50 | | | | | |
| | 2.800 | 0.140 | 110 | | | | | |
| B | 4.100 | 0.160 | 60 | 372 | 3.767 | 0.160 | 23.5 | 325.2 |
| | 3.700 | 0.160 | 240 | | | | | |
| | 3.500 | 0.160 | 72 | | | | | |
| C | 4.200 | 0.180 | 60 | 372 | 3.967 | 0.180 | 22.0 | 365.7 |
| | 3.900 | 0.180 | 240 | | | | | |
| | 3.800 | 0.180 | 72 | | | | | |
| D | 4.100 | 0.200 | 60 | 372 | 3.767 | 0.200 | 18.8 | 365.9 |
| | 3.700 | 0.200 | 240 | | | | | |
| | 3.500 | 0.200 | 72 | | | | | |
| E | 4.200 | 0.165 | 60 | 372 | 3.967 | 0.165 | 24.0 | 260.7 |
| | 3.900 | 0.165 | 240 | | | | | |
| | 3.800 | 0.165 | 72 | | | | | |
| F | 4.100 | 0.250 | 60 | 372 | 3.767 | 0.250 | 15.1 | 457.4 |
| | 3.700 | 0.250 | 240 | | | | | |
| | 3.500 | 0.250 | 72 | | | | | |
| G | 4.200 | 0.125 | 60 | 372 | 3.967 | 0.125 | 31.7 | 282.2 |
| | 3.900 | 0.125 | 240 | | | | | |
| | 3.800 | 0.125 | 72 | | | | | |

TABLE 4

| | Example | | | | |
|---|---|---|---|---|---|
| | 1 | 2 | 3 | 4 | 5 |
| Core | | | | | |
| Type | a | b | c | d | e |
| Hardness (mm) | 2.8 | 2.5 | 3.3 | 3.0 | 4.5 |

TABLE 4-continued

| | Example | | | | |
|---|---|---|---|---|---|
| | 1 | 2 | 3 | 4 | 5 |
| Intermediate layer | | | | | |
| Type | — | — | — | — | 7 |
| Gage (mm) | — | — | — | — | 1.5 |
| Shore D hardness | — | — | — | — | 30 |
| Cover inner layer | | | | | |
| Type | 1 | 2 | 3 | 4 | 2 |
| Gage (mm) | 1.65 | 1.65 | 1.65 | 1.65 | 1.5 |
| Hardness A (Shore D) | 63 | 55 | 53 | 40 | 55 |
| Cover outer layer | | | | | |
| Type | 4 | 5 | 6 | 5 | 4 |
| Gage (mm) | 1.5 | 1.5 | 1.5 | 1.5 | 1.5 |
| Hardness B (Shore D) | 40 | 50 | 45 | 50 | 40 |
| Hardness product A × B | 2520 | 2750 | 2385 | 2000 | 2200 |
| Dimples | | | | | |
| Set | A | B | A | D | C |
| AD/AP | 25.1 | 23.5 | 25.1 | 18.8 | 22.0 |
| Overall volume ($mm^3$) | 301.8 | 325.2 | 301.8 | 365.9 | 365.7 |
| Ball | | | | | |
| Hardness (mm) | 2.6 | 2.45 | 3.2 | 2.8 | 4.2 |
| Diameter (mm) | 42.7 | 42.7 | 42.7 | 42.7 | 42.7 |
| Weight (g) | 45.3 | 45.3 | 45.3 | 45.3 | 45.3 |
| Flight performance, W#1/HS40 | | | | | |
| Spin (rpm) | 3150 | 2850 | 2895 | 2810 | 3230 |
| Carry (m) | 187.3 | 186.9 | 187.0 | 187.3 | 187.1 |
| Total (m) | 199.7 | 200.6 | 200.1 | 199.8 | 198.2 |
| Trajectory | slightly high, gradually rising, boring trajectory | slightly low, gradually rising, boring trajectory | slightly high, gradually rising, boring trajectory | moderately low, gradually rising, boring trajectory | moderately low, gradually rising, boring trajectory |
| Rating | ○ | ○ | ○ | ○ | ○ |
| Approach control | ○ | ○ | ○ | ○ | ○ |
| Feel | | | | | |
| W#1 | ○ | ○ | ○ | ○ | ○ |
| PT | ○ | ○ | ○ | ○ | ○ |
| Durability | ○ | ○ | ○ | ○ | ○ |
| Overall evaluation | ○ | ○ | ○ | ○ | ○ |

TABLE 5

| | Comparative Example | | | |
|---|---|---|---|---|
| | 1 | 2 | 3 | 4 |
| Core | | | | |
| Type | c | b | a | d |
| Hardness (mm) | 3.3 | 2.5 | 2.8 | 3.0 |
| Intermediate layer | | | | |
| Type | — | — | — | — |
| Gage (mm) | — | — | — | — |
| Shore D hardness | — | — | — | — |
| Cover inner layer | | | | |
| Type | 3 | 2 | 1 | 4 |
| Gage (mm) | 1.65 | 1.65 | 1.65 | 1.65 |
| Hardness A (Shore D) | 53 | 55 | 63 | 40 |

TABLE 5-continued

| | Comparative Example | | | |
|---|---|---|---|---|
| | 1 | 2 | 3 | 4 |
| Cover outer layer | | | | |
| Type | 6 | 5 | 4 | 1 |
| Gage (mm) | 1.5 | 1.5 | 1.5 | 1.5 |
| Hardness B (Shore D) | 45 | 50 | 40 | 63 |
| Hardness product A × B | 2385 | 2750 | 2520 | 2520 |
| Dimples | | | | |
| Set | E | F | G | D |
| AD/AP | 24.0 | 15.1 | 31.7 | 18.8 |
| Overall volume ($mm^3$) | 260.7 | 457.4 | 282.2 | 365.9 |
| Ball | | | | |
| Hardness (mm) | 3.2 | 2.45 | 2.6 | 2.6 |
| Diameter (mm) | 42.7 | 42.7 | 42.7 | 42.7 |
| Weight (g) | 45.3 | 45.3 | 45.3 | 45.3 |

TABLE 5-continued

| | Comparative Example | | | |
|---|---|---|---|---|
| | 1 | 2 | 3 | 4 |
| Flight performance, W#1/HS40 | | | | |
| Spin (rpm) | 2900 | 2850 | 3145 | 2520 |
| Carry (m) | 174.5 | 184.5 | 175.0 | 186.0 |
| Total (m) | 185.6 | 194.0 | 186.0 | 196.2 |
| Trajectory | ballooning trajectory | nose-down trajectory | ballooning trajectory | slightly nose-down |
| Rating | x | x | x | x |
| Approach control | ○ | ○ | ○ | x |
| Feel | | | | |
| W#1 | ○ | ○ | ○ | x |
| PT | ○ | ○ | ○ | x |
| Durability | ○ | ○ | ○ | Δ |
| Overall evaluation | x | x | x | x |

As is evident from Tables 4 and 5, the golf balls of Examples 1 to 5 are superior in a 1 of flight performance, approach control, feel, and durability.

Japanese Patent Application No. 11-028771 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising a core and a cover of at least two layers around the core including a cover outermost layer which is formed with a plurality of dimples, wherein said cover outermost layer has a Shore D hardness of 30 to less than 51, the product (A×B) of the Shore D hardness of said cover outermost layer, represented by B, multiplied by the Shore D hardness of a cover layer disposed inside and contiguous to said cover outermost layer, represented by A, is in the range of 1,000 to 3,500, the plurality of dimples include at least three types of dimples which are different in diameter and have an average diameter (AD) and an average depth (AP) wherein the ratio (AD/AP) of the average diameter to the average depth is from 17/1 to 26/1, the overall dimple volume which is the sum of the volumes of all dimple spaces each defined below a plane circumscribed by a dimple edge is in the range of 280 to 390 $mm^3$, and wherein the product of (A×B) of the Shore D hardness B of said cover outermost layer multiplied by the Shore D hardness A of a cover layer disposed inside and contiguous to said cover outermost layer and the overall dimple volume (Vs) are correlated such that Vs becomes smaller when A×B has a large value, and Vs becomes greater when A×B has a small value.

2. The golf ball of claim 1 wherein Vs is 310 to 390 $mm^3$ when A×B is from 1,000 to 2,500, and Vs is 280 to 340 $mm^3$ when A×B is from 2,000 to 3,500.

3. The golf ball of claim 1 wherein said core is formed of a rubber composition based on cis-1,4-polybutadiene.

4. The golf ball of claim 1 wherein the total number of dimples is 370 to 450.

5. The golf ball of claim 1, wherein said cover outermost layer has a Shore D hardness of 33 to 50.

6. The golf ball of claim 1, wherein said core has a hardness corresponding to a deflection of 3.0 to 6.0 mm under an applied load of 100 kg.

7. The golf ball of claim 1, wherein said cover inner and outer layers are formed of cover stocks based on ionomer resins.

8. The golf ball of claim 1, wherein the golf ball as a whole has a hardness corresponding to a deflection of 2.4 to 4.5 mm.

9. A golf ball comprising a core and a cover of at least two layers around the core including a cover outermost layer which is formed with a plurality of dimples, wherein said cover outermost layer has a Shore D hardness of 30 to less than 51, the product (A×B) of the Shore D hardness of said cover outermost layer, represented by B, multiplied by the Shore D hardness of a cover layer disposed inside and contiguous to said cover outermost layer, represented by A, is in the range of 1,000 to 3,500, the plurality of dimples include at least three types of dimples which are different in diameter and have an average diameter (AD) and an average depth (AP) wherein the ratio (AD/AP) of the average diameter to the average depth is from 17/1 to 26/1, the overall dimple volume which is the sum of the volumes of all dimple spaces each defined below a plane circumscribed by a dimple edge is in the range of 280 to 390 $mm^3$, and wherein Vs is 310 to 390 $mm^3$ when A×B is from 1,000 to 2,500, and Vs is 280 to 340 $mm^3$ when A×B is from 2,000 to 3,500.

10. The golf ball of claim 9 wherein said core is formed of a rubber composition based on cis-1,4-polybutadiene.

11. The golf ball of claim 9 wherein the total number of dimples is 370 to 450.

12. The golf ball of claim 9, wherein said cover outermost layer has a Shore D hardness of 33 to 50.

13. The golf ball of claim 9, wherein said core has a hardness corresponding to a deflection of 3.0 to 6.0 mm under an applied load of 100 kg.

14. The golf ball of claim 9, wherein said cover inner and outer layers are formed of cover stocks based on ionomer resins.

15. The golf ball of claim 9, wherein the golf ball as a whole has a hardness corresponding to a deflection of 2.4 to 4.5 mm.

* * * * *